US011589726B2

(12) United States Patent
Dirisala et al.

(10) Patent No.: US 11,589,726 B2
(45) Date of Patent: Feb. 28, 2023

(54) MOUNTING BRACKET FOR A DISHWASHER

(71) Applicant: Whirlpool Corporation, Benton Harbor, MI (US)

(72) Inventors: Venkata S. Dirisala, Benton Harbor, MI (US); Richard Lawrence Kretz, Jr., Findlay, OH (US); Daniel J. Lesko, Kalamazoo, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 313 days.

(21) Appl. No.: 16/364,937

(22) Filed: Mar. 26, 2019

(65) Prior Publication Data

US 2020/0305681 A1 Oct. 1, 2020

(51) Int. Cl.
*A47L 15/42* (2006.01)

(52) U.S. Cl.
CPC ..... *A47L 15/4225* (2013.01)

(58) Field of Classification Search
CPC ..... A47L 15/4225
See application file for complete search history.

(56) References Cited

U.S. PATENT DOCUMENTS 3,446,155 A * 5/1969 Guth ..... A47L 15/4225 417/363
6,141,995 A * 11/2000 Johnson ..... D06F 39/085 68/3 R
9,307,885 B2 4/2016 Welch
9,332,889 B2 5/2016 Fadler et al.
10,076,226 B2 9/2018 Blanchard et al.
2010/0327127 A1* 12/2010 Crane ..... D06F 58/20 248/346.03
2013/0068266 A1* 3/2013 Bennett ..... A47L 15/4246 134/184
2015/0000713 A1* 1/2015 Vallejo Noriega ..... A47L 15/4285 134/108
2016/0015242 A1* 1/2016 Shin ..... A47L 15/4209 134/104.2
2017/0096768 A1* 4/2017 Kim ..... D06F 37/12
2017/0296027 A1 10/2017 Geda
(Continued)

FOREIGN PATENT DOCUMENTS

CN 104047148 A * 9/2014 ..... D06F 37/20
CN 207734133 U 8/2018
(Continued)

OTHER PUBLICATIONS

European Patent Office, European Search Report re Corresponding Application No. 20157795.4-1016, dated Apr. 14, 2020, 7 pages, Munich, Germany.

*Primary Examiner* — Joseph L. Perrin
*Assistant Examiner* — Irina Graf
(74) *Attorney, Agent, or Firm* — McGarry Bair PC

(57) ABSTRACT

An automatic dishwasher can include a tub having a bottom and at least partially defining an open face treating chamber, a base supporting the bottom of the tub and defining a mechanical area beneath the bottom of the tub, at least one sprayer emitting liquid into the treating chamber, and a rotating inlet filter assembly fluidly coupling the treating chamber to the at least one sprayer. A mounting bracket can be provided to secure the rotating inlet filter assembly to the base.

13 Claims, 6 Drawing Sheets

(56) References Cited

U.S. PATENT DOCUMENTS

| | | | | |
|---|---|---|---|---|
| 2018/0135223 | A1* | 5/2018 | Chung | D06F 39/085 |
| 2020/0024789 | A1* | 1/2020 | Guzman | D06F 39/085 |

FOREIGN PATENT DOCUMENTS

| | | | | | |
|---|---|---|---|---|---|
| CN | 110529391 | A | * | 12/2019 | |
| DE | 2157590 | A1 | * | 5/1973 | A47L 15/4225 |
| DE | 9108936 | U1 | | 2/1992 | |
| EP | 1956263 | A1 | | 8/2008 | |
| KR | 20120108473 | A | * | 10/2012 | |
| WO | 0054392 | A1 | | 9/2000 | |

* cited by examiner

MOUNTING BRACKET FOR A DISHWASHER

BACKGROUND

Contemporary automatic dishwashers for use in a typical household include a tub, at least one rack or basket for supporting soiled dishes within the tub, and a door for opening and closing the tub. Dishwashers can also include mounting hardware for securing various elements of the dishwasher to a frame. Examples of such elements include a pump, such as a recirculation or drain pump, which is fluidly coupled to the tub and which can be supported by a mounting bracket coupled to the frame.

BRIEF DESCRIPTION

The disclosure relates to an automatic dishwasher including a tub having a bottom and at least partially defining an open face treating chamber, a base supporting the bottom of the tub and defining a mechanical area beneath the bottom of the tub, at least one sprayer emitting liquid into the treating chamber, a recirculation circuit fluidly coupling the tub to the at least one sprayer, a drain circuit fluidly coupling the tub to a household drain, a pump assembly having a pump fluidly coupled to at least one of the recirculation or drain circuits and a motor driving the pump, a mounting bracket securing the pump assembly to the base, and a bracket axis defined along the mounting bracket, wherein the pump assembly has at least one degree of freedom along the bracket axis.

DETAILED DESCRIPTION

Aspects of the disclosure generally relate to mounting hardware for securing components to a frame, base, chassis, or the like. One exemplary environment includes household appliances that can include motors or other moving parts. Typical mounting brackets can include U-shaped arms to partially surround elements, such as motor housings, that may be moving or vibrating in order to constrain movement of such elements during operation of the appliance. In such a case, such U-shaped arms can constrain movement; however, lateral motion or vibrations generated by the constrained element can be transferred laterally to the bracket, and possibly also transferred to other components mounted nearby the constrained element.

Aspects will be described herein in the context of an automatic dishwasher, and it will be understood that the disclosure is not so limited and may have general applicability in other environments, such as other household or commercial appliances.

Figure 1:
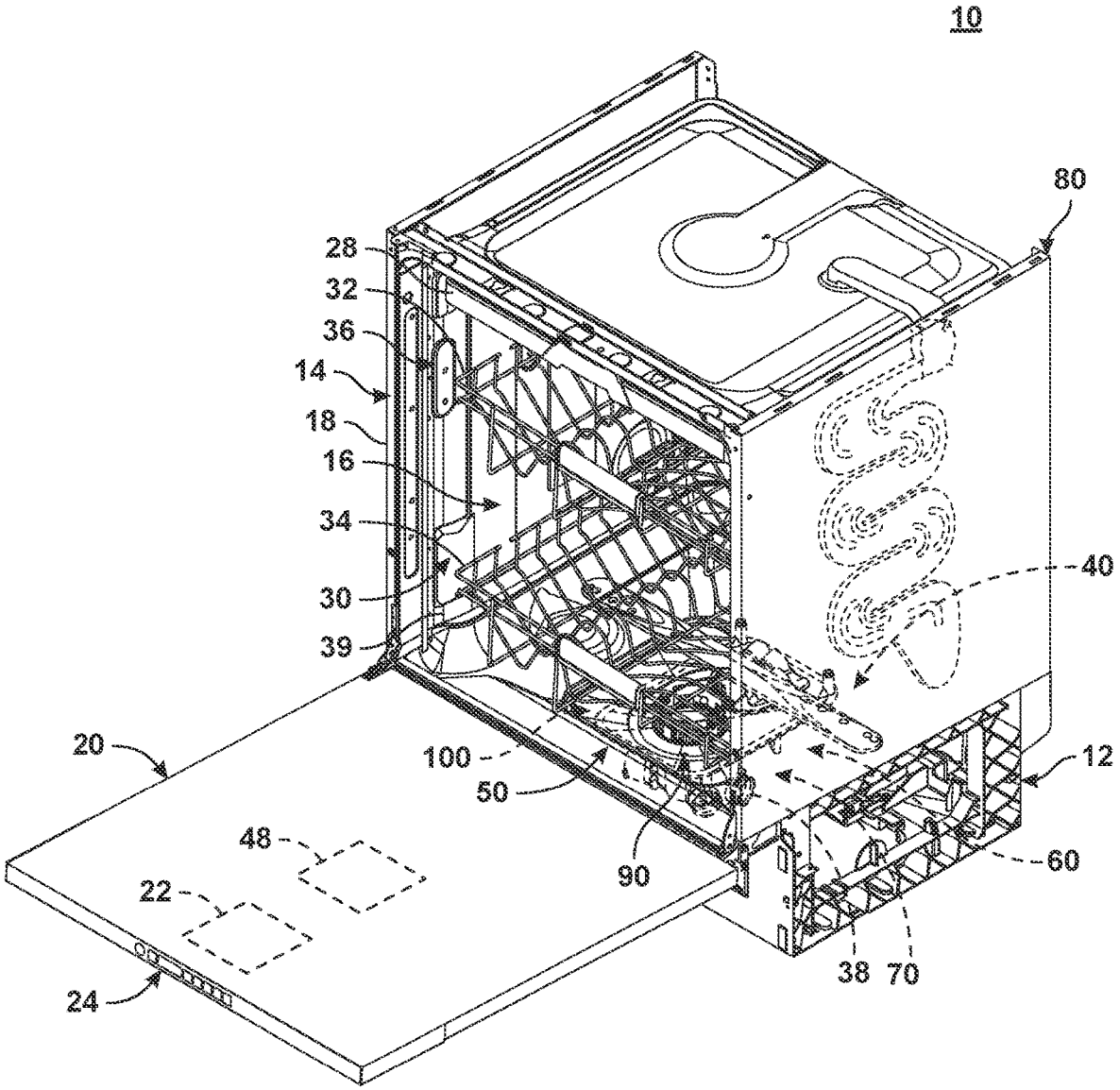
FIG. 1 is a right-side perspective view of an automatic dishwasher having multiple systems for implementing an automatic cycle of operation.

FIG. 1 illustrates an automatic dishwasher 10 capable of implementing an automatic cycle of operation to treat dishes. As used in this description, the term "dish(es)" is intended to be generic to any item, single or plural, that can be treated in the dishwasher 10, including, without limitation, dishes, plates, pots, bowls, pans, glassware, and silverware. As illustrated, the dishwasher 10 is a built-in dishwasher implementation, which is designed for mounting under a countertop. However, this description is applicable to other dishwasher implementations such as a stand-alone, drawer-type or a sink-type, for example.

The dishwasher 10 has a variety of systems, some of which are controllable, to implement the automatic cycle of operation. A chassis is provided to support the variety of systems needed to implement the automatic cycle of operation. As illustrated, for a built-in implementation, the chassis includes a frame in the form of a base 12 on which is supported an open-faced tub 14, which at least partially defines a treating chamber 16, having an open face 18, for receiving the dishes. A closure in the form of a door assembly 20 is pivotally mounted to the base 12 for movement between opened and closed positions to selectively open and close the open face 18 of the tub 14. Thus, the door assembly 20 provides selective accessibility to the treating chamber 16 for the loading and unloading of dishes or other items.

The chassis, as in the case of the built-in dishwasher implementation, can be formed by other parts of the dishwasher 10, like the tub 14 and the door assembly 20, in addition to a dedicated frame structure, like the base 12, with them all collectively forming a uni-body frame to which the variety of systems are supported. In other implementations, like the drawer-type dishwasher, the chassis can be a tub that is slidable relative to a frame, with the closure being a part of the chassis or the countertop of the surrounding cabinetry. In a sink-type implementation, the sink forms the tub and the cover closing the open top of the sink forms the closure. Sink-type implementations are more commonly found in recreational vehicles.

The systems supported by the chassis, while essentially limitless, can include dish holding system 30, spray system 40, recirculation system 50, drain system 60, water supply system 70, drying system 80, heating system 90, and filter system 100. These systems are used to implement one or more treating cycles of operation for the dishes, for which there are many, and one of which includes a traditional automatic wash cycle.

A basic traditional automatic wash cycle of operation has a wash phase, where a detergent/water mixture is recirculated and then drained, which is then followed by a rinse phase where water alone or with a rinse agent is recirculated and then drained. An optional drying phase can follow the rinse phase. More commonly, the automatic wash cycle has multiple wash phases and multiple rinse phases. The multiple wash phases can include a pre-wash phase where water, with or without detergent, is sprayed or recirculated on the dishes, and can include a dwell or soaking phase. There can be more than one pre-wash phases. A wash phase, where water with detergent is recirculated on the dishes, follows the pre-wash phases. There can be more than one wash phase; the number of which can be sensor controlled based on the amount of sensed soils in the wash liquid. One or more rinse phases will follow the wash phase(s), and, in some cases, come between wash phases. The number of wash phases can also be sensor controlled based on the amount of sensed soils in the rinse liquid. The wash phases and rinse phases can included the heating of the water, even to the point of one or more of the phases being hot enough for long enough to sanitize the dishes. A drying phase can follow the rinse phase(s). The drying phase can include a drip dry, heated dry, condensing dry, air dry or any combination.

A controller 22 can also be included in the dishwasher 10 and operably couples with and controls the various components of the dishwasher 10 to implement the cycle of operation. The controller 22 can be located within the door assembly 20 as illustrated, or it can alternatively be located somewhere within the chassis. The controller 22 can also be operably coupled with a control panel or user interface 24 for receiving user-selected inputs and communicating information to the user. The user interface 24 can include operational controls such as dials, lights, switches, and displays enabling a user to input commands, such as a cycle of operation, to the controller 22 and receive information.

The dish holding system 30 can include any suitable structure for holding dishes within the treating chamber 16. Exemplary dish holders are illustrated in the form of an upper dish rack 32 and a lower dish rack 34, commonly referred to as "racks", which are located within the treating chamber 16. The upper dish rack 32 and lower dish rack 34 are typically mounted for slidable movement in and out of the treating chamber 16 through the open face 18 for ease of loading and unloading. Drawer guides/slides/rails 36 are typically used to slidably mount the upper dish rack 32 to the tub 14. The lower dish rack 34 typically has wheels or rollers 38 that roll along rails 39 formed in sidewalls of the tub 14 and onto the door assembly 20, when the door assembly 20 is in the opened position.

Dedicated dish holders can also be provided. One such dedicated dish holder is a third level rack 28 located above the upper dish rack 32. Like the upper dish rack 32, the third level rack is slideably mounted to the tub 14 with drawer guides/slides/rails 36. The third level rack 28 is typically used to hold utensils, such as tableware, spoons, knives, spatulas, etc., in an on-the-side or flat orientation. However, the third level rack 28 is not limited to holding utensils. If an item can fit in the third level rack, it can be washed in the third level rack 28. The third level rack 28 generally has a much shorter height or lower profile than the upper and lower dish racks 32, 34. Typically, the height of the third level rack is short enough that a typical glass cannot be stood vertically in the third level rack 28 and still have the third level rack 28 slide into the treating chamber 16.

Another dedicated dish holder can be a silverware basket (not shown), which is typically carried by one of the upper or lower dish racks 32, 34 or mounted to the door assembly 20. The silverware basket typically holds utensils and the like in an upright orientation as compared to the on-the-side or flat orientation of the third level rack 28.

A dispenser assembly 48 is provided to dispense treating chemistry, e.g. detergent, anti-spotting agent, etc., into the treating chamber 16. The dispenser assembly 48 can be mounted on an inner surface of the door assembly 20, as shown, or can be located at other positions within the chassis. The dispenser assembly 48 can dispense one or more types of treating chemistries. The dispenser assembly 48 can be a single-use dispenser or a bulk dispenser, or a combination of both.

Figure 2:
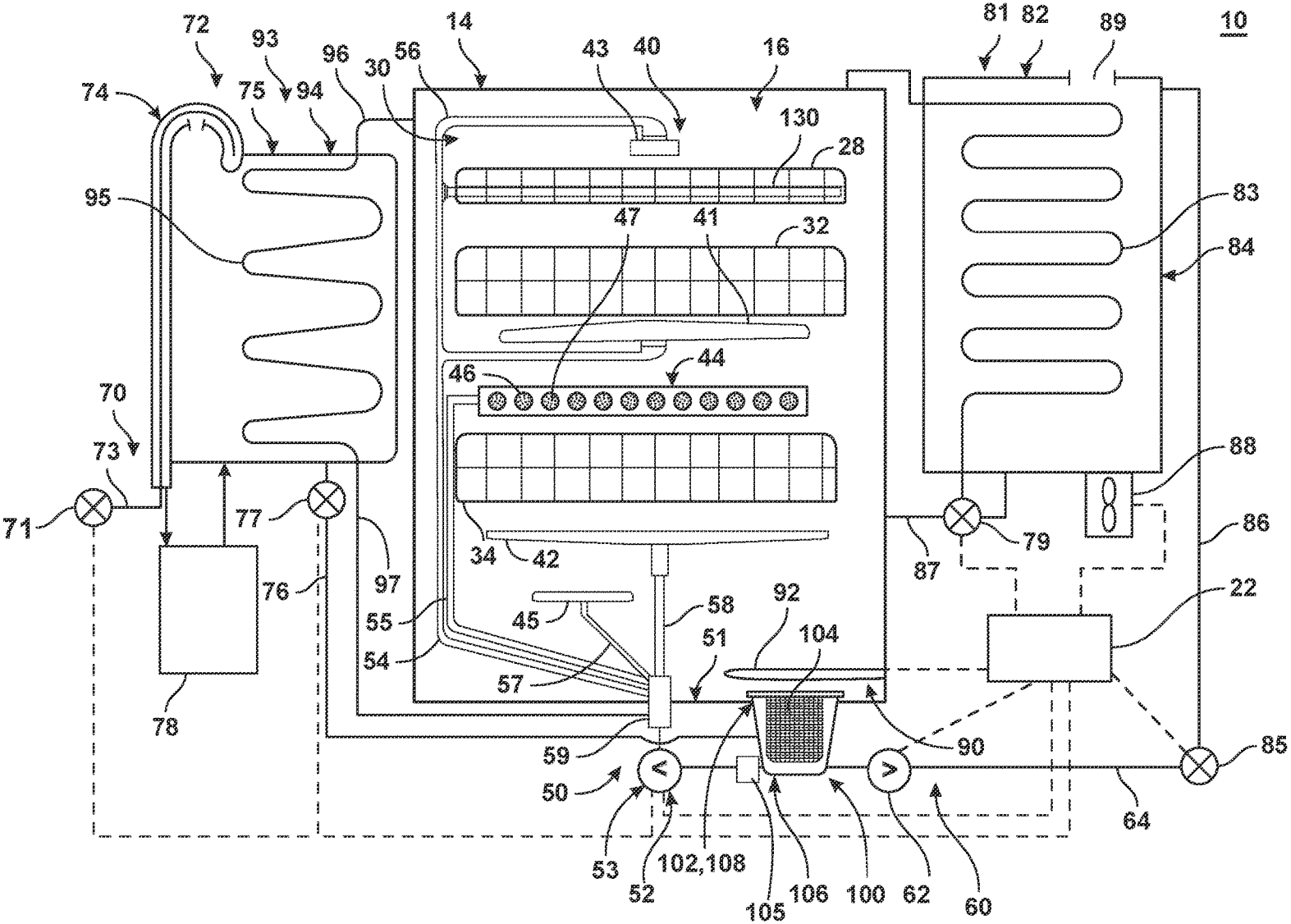
FIG. 2 is a schematic view of the dishwasher of FIG. 1 and illustrating at least some of the plumbing and electrical connections between at least some of systems.

Turning to FIG. 2, the spray system 40 is provided for spraying liquid in the treating chamber 16 and can have multiple spray assemblies or sprayers, some of which can be dedicated to a particular one of the dish holders, to particular area of a dish holder, to a particular type of cleaning, or to a particular level of cleaning, etc. The sprayers can be fixed or movable, such as rotating, relative to the treating chamber 16 or dish holder. Six exemplary sprayers are illustrated and include an upper spray arm 41, a lower spray arm 42, a third level sprayer 43, a deep-clean sprayer 44, and a spot sprayer 45. The six sprayers 41, 42, 43, 44, 45, 46 are illustrative examples of suitable sprayers and are not meant to be limiting as to the type of suitable sprayers.

The upper spray arm 41 and lower spray arm 42 are rotating spray arms, located below the upper dish rack 32 and lower dish rack 34, respectively, and rotate about a generally centrally located and vertical axis. The third level sprayer 43 is located above the third level rack 28. The third level sprayer 43 can be fixed or movable, such as by rotating. In addition to or in place of the third level sprayer 43, another sprayer 130 can be located at least in part below a portion of the third level rack 28. The sprayer 130 is illustrated as a fixed tube, carried by the third level rack 28, but could move, such as in rotating about a longitudinal axis.

The deep-clean sprayer 44 is a manifold extending along a rear wall of the tub 14 and has multiple nozzles 46 with multiple apertures 47 generating an intensified and/or higher pressure spray than the upper spray arm 41, the lower spray arm 42, or the third level sprayer 43. The nozzles 46 can be fixed or movable, such as by rotating. The spray emitted by the deep-clean sprayer 44 defines a deep clean zone which is illustrated along a rear side of the lower dish rack 34. Thus, dishes needing deep cleaning, such as dishes with baked-on food, can be located in the lower dish rack 34 to face the deep-clean sprayer 44. The deep-clean sprayer 44, while illustrated as only one unit on a rear wall of the tub 14 could comprise multiple units and/or extend along multiple portions, including different walls, of the tub 14, and can be provided above, below or beside any of the dish holders when deep-cleaning is desired.

The spot sprayer 45 can also emit an intensified and/or higher pressure spray similar to the deep-clean sprayer 44, such as to a discrete location within one of the dish holders. While the spot sprayer 45 is shown below the lower dish rack 34, it could be adjacent any part of any dish holder or along any wall of the tub where special cleaning is desired. In the illustrated location below the lower dish rack 34, the spot sprayer can be used independently of or in combination with the lower spray arm 42. The spot sprayer 45 can also be fixed or movable, such as by rotating.

The recirculation system 50 recirculates the liquid sprayed by the spray system 40 into the treating chamber 16 back to the sprayers to form a recirculation loop or circuit by which liquid can be repeatedly and/or continuously sprayed onto dishes in the dish holders. The recirculation system 50 can include a sump 51 and a pump assembly 52. The sump 51 collects the liquid sprayed in the treating chamber 16 and can be formed by a sloped or recess portion of a bottom wall of the tub 14. The pump assembly 52 can include one or more pumps, and is illustrated with a recirculation pump 53. The sump 51 can also be a separate module that is affixed to the bottom wall and include the pump assembly 52.

Multiple supply conduits 54, 55, 56, 57, 58 fluidly couple the sprayers 41-45 to the recirculation pump 53. A recirculation valve 59 can selectively fluidly couple each of the conduits 54-58 to the recirculation pump 53. While each sprayer 41-45 is illustrated as having a corresponding dedicated supply conduit 54-58, one or more subsets comprising multiple sprayers from the total group of sprayers 41-45 can be supplied by the same conduit, negating the need for a dedicated conduit for each sprayer. For example, a single conduit can supply the upper spray arm 41 and the third level sprayer 43. Another example is that the sprayer 130 is supplied with liquid by the conduit 56, which also supplies the third level sprayer 43.

The recirculation valve 59, while illustrated as a single valve, can be implemented with multiple valves. Additionally, one or more of the supply conduits 54-58 can be directly coupled to the recirculation pump 53, while one or more of the other supply conduits 54-58 can be selectively coupled to the recirculation pump 53 with one or more valves. There are essentially an unlimited number of plumbing schemes to connect the recirculation system 50 to the spray system 40. The illustrated plumbing is not limiting.

A drain system 60 forms a drain circuit to drain liquid from the treating chamber 16. The drain system 60 includes a drain pump 62 fluidly coupled the treating chamber 16 to a drain line 64. As illustrated the drain pump 62 fluidly couples the sump 51 to the drain line 64.

While separate recirculation and drain pumps 53 and 62 are illustrated, a single pump can be used to perform both the recirculating and the draining functions. Alternatively, the drain pump 62 can be used to recirculate liquid in combination with the recirculation pump 53. When both a recirculation pump 53 and drain pump 62 are used, the drain pump 62 is typically more robust than the recirculation pump 53 as the drain pump 62 tends to have to remove solids and soils from the sump 51, unlike the recirculation pump 53, which tends to recirculate liquid which has solids and soils filtered away to some extent.

A water supply system 70 is provided for supplying fresh water to the dishwasher 10 from a household water supply via a household water valve 71. The water supply system 70 includes a water supply unit 72 having a water supply conduit 73 with a siphon break 74. While the water supply conduit 73 can be directly fluidly coupled to the tub 14 or any other portion of the dishwasher 10, the water supply conduit is shown fluidly coupled to a supply tank 75, which can store the supplied water prior to use. The supply tank 75 is fluidly coupled to the sump 51 by a supply line 76, which can include a controllable valve 77 to control when water is released from the supply tank 75 to the sump 51.

The supply tank 75 can be conveniently sized to store a predetermined volume of water, such as a volume required for a phase of the cycle of operation, which is commonly referred to as a "charge" of water. The storing of the water in the supply tank 75 prior to use is beneficial in that the water in the supply tank 75 can be "treated" in some manner, such as softening or heating prior to use.

A water softener 78 is provided with the water supply system 70 to soften the fresh water. The water softener 78 is shown fluidly coupling the water supply conduit 73 to the supply tank 75 so that the supplied water automatically passes through the water softener 78 on the way to the supply tank 75. However, the water softener 78 could directly supply the water to any other part of the dishwasher 10 than the supply tank 75, including directly supplying the tub 14. Alternatively, the water softener 78 can be fluidly coupled downstream of the supply tank 75, such as in-line with the supply line 76. Wherever the water softener 78 is fluidly coupled, it can be done so with controllable valves, such that the use of the water softener 78 is controllable and not mandatory.

A drying system 80 is provided to aid in the drying of the dishes during the drying phase. The drying system as illustrated includes a condensing assembly 81 having a condenser 82 formed of a serpentine conduit 83 with an inlet fluidly coupled to an upper portion of the tub 14 and an outlet fluidly coupled to a lower portion of the tub 14, whereby moisture laden air within the tub 14 is drawn from the upper portion of the tub 14, passed through the serpentine conduit 83, where liquid condenses out of the moisture laden air and is returned to the treating chamber 16 where it ultimately evaporates or is drained via the drain pump 62. The serpentine conduit 83 can be operated in an open loop configuration, where the air is exhausted to atmosphere, a closed loop configuration, where the air is returned to the treating chamber, or a combination of both by operating in one configuration and then the other configuration.

To enhance the rate of condensation, the temperature difference between the exterior of the serpentine conduit 83 and the moisture laden air can be increased by cooling the exterior of the serpentine conduit 83 or the surrounding air. To accomplish this, an optional cooling tank 84 is added to the condensing assembly 81, with the serpentine conduit 83 being located within the cooling tank 84. The cooling tank 84 is fluidly coupled to at least one of the spray system 40, recirculation system 50, drain system 60 or water supply system 70 such that liquid can be supplied to the cooling tank 84. The liquid provided to the cooling tank 84 from any of the systems 40-70 can be selected by source and/or by phase of cycle of operation such that the liquid is at a lower temperature than the moisture laden air or even lower than the ambient air.

As illustrated, the liquid is supplied to the cooling tank 84 by the drain system 60. A valve 85 fluidly connects the drain line 64 to a cooling supply conduit 86 fluidly coupled to the cooling tank 84. A return conduit 87 fluidly connects the cooling tank 84 back to the treating chamber 16 via a return valve 79. In this way a fluid circuit is formed by the drain pump 62, drain line 64, valve 85, cooling supply conduit 86, cooling tank 84, return valve 79 and return conduit 87 through which liquid can be supplied from the treating chamber 16, to the cooling tank 84, and back to the treating chamber 16. Alternatively, the supply conduit 86 could fluidly couple to the drain line 64 if re-use of the water is not desired.

To supply cold water from the household water supply via the household water valve 71 to the cooling tank 84, the water supply system 70 would first supply cold water to the treating chamber 16, then the drain system 60 would supply the cold water in the treating chamber 16 to the cooling tank 84. It should be noted that the supply tank 75 and cooling tank 84 could be configured such that one tank performs both functions.

The drying system 80 can also use ambient air, instead of cold water, to cool the exterior of the serpentine conduit 83. In such a configuration, a blower 88 is connected to the cooling tank 84 and can supply ambient air to the interior of the cooling tank 84. The cooling tank 84 can have a vented top 89 to permit the passing through of the ambient air to allow for a steady flow of ambient air blowing over the serpentine conduit 83.

The cooling air from the blower 88 can be used in lieu of the cold water or in combination with the cold water. The cooling air will be used when the cooling tank 84 is not filled with liquid. Advantageously, the use of cooling air or cooling water, or combination of both, can be selected on the site-specific environmental conditions. If ambient air is cooler than the cold water temperature, then the ambient air can be used. If the cold water is cooler than the ambient air, then the cold water can be used. Cost-effectiveness can also be taken into account when selecting between cooling air and cooling water. The blower 88 can be used to dry the interior of the cooling tank 84 after the water has been drained. Suitable temperature sensors for the cold water and the ambient air can be provided and send their temperature signals to the controller 22, which can determine which of the two is colder at any time or phase of the cycle of operation.

A heating system 90 is provided for heating water used in the cycle of operation. The heating system 90 includes a heater 92, such as an immersion heater, located in the treating chamber 16 at a location where it will be immersed by the water supplied to the treating chamber 16. The heater 92 need not be an immersion heater, it can also be an in-line heater located in any of the conduits. There can also be more than one heater 92, including both an immersion heater and an in-line heater.

The heating system 90 can also include a heating circuit 93, which includes a heat exchanger 94, illustrated as a serpentine conduit 95, located within the supply tank 75, with a supply conduit 96 supplying liquid from the treating chamber 16 to the serpentine conduit 95, and a return conduit 97 fluidly coupled to the treating chamber 16. The heating circuit 93 is fluidly coupled to the recirculation pump 53 either directly or via the recirculation valve 59 such that liquid that is heated as part of a cycle of operation can be recirculated through the heat exchanger 94 to transfer the heat to the charge of fresh water residing in the supply tank 75. As most wash phases use liquid that is heated by the heater 92, this heated liquid can then be recirculated through the heating circuit 93 to transfer the heat to the charge of water in the supply tank 75, which is typically used in the next phase of the cycle of operation.

A filter system 100 is provided to filter un-dissolved solids from the liquid in the treating chamber 16. The filter system 100 includes a coarse filter 102 and a fine filter 104, which can be a removable basket 106 residing the sump 51, with the coarse filter 102 being a screen 108 circumscribing the removable basket 106. A rotating inlet filter (RIF) assembly 105, also referred to as "filter assembly 105," can be provided in the filter system 100. While illustrated with the coarse and fine filters 102, 104 and filter assembly 105, the filter system 100 can also include the filter assembly 105 without either or both of the coarse and fine filters 102, 104. The rotating inlet filter assembly 105 can also replace the sump 51, and filter 104, with rotating inlet filter assembly 105 forming the sump 51. Other filter arrangements are also contemplated, such as an ultrafiltration system.

Figure 3:
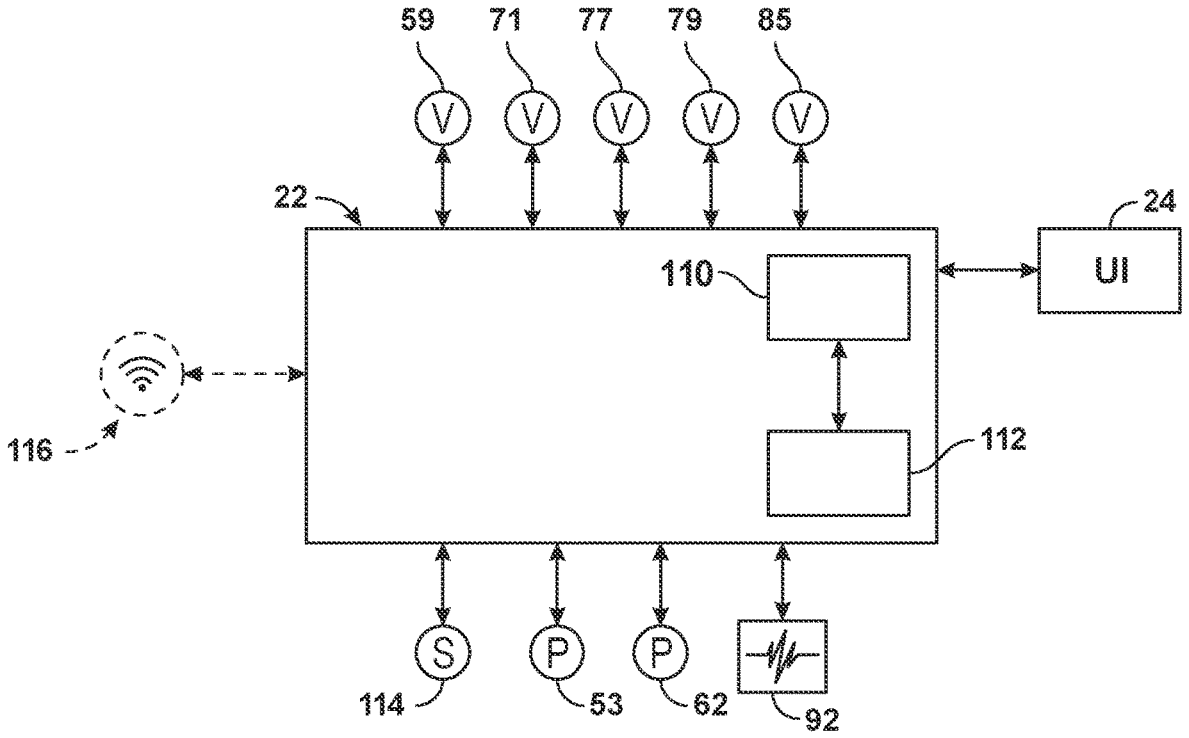
FIG. 3 is a schematic view of a controller of the dishwasher of FIGS. 1 and 2.

As illustrated schematically in FIG. 3, the controller 22 can be coupled with the heater 92 for heating the wash liquid during a cycle of operation, the drain pump 62 for draining liquid from the treating chamber 16, and the recirculation pump 53 for recirculating the wash liquid during the cycle of operation. The controller 22 can be provided with a memory 110 and a central processing unit (CPU) 112. The memory 110 can be used for storing control software that can be executed by the CPU 112 in completing a cycle of operation using the dishwasher 10 and any additional software. For example, the memory 110 can store one or more pre-programmed automatic cycles of operation that can be selected by a user and executed by the dishwasher 10. The controller 22 can also receive input from one or more sensors 114. Non-limiting examples of sensors that can be communicably coupled with the controller 22 include, to name a few, ambient air temperature sensor, treating chamber temperature sensor, water supply temperature sensor, door open/close sensor, and turbidity sensor to determine the soil load associated with a selected grouping of dishes, such as the dishes associated with a particular area of the treating chamber. The controller 22 can also communicate with the recirculation valve 59, household water valve 71, controllable valve 77, return valve 79, and the valve 85. Optionally, the controller 22 can include or communicate with a wireless communication device 116.

Figure 4:
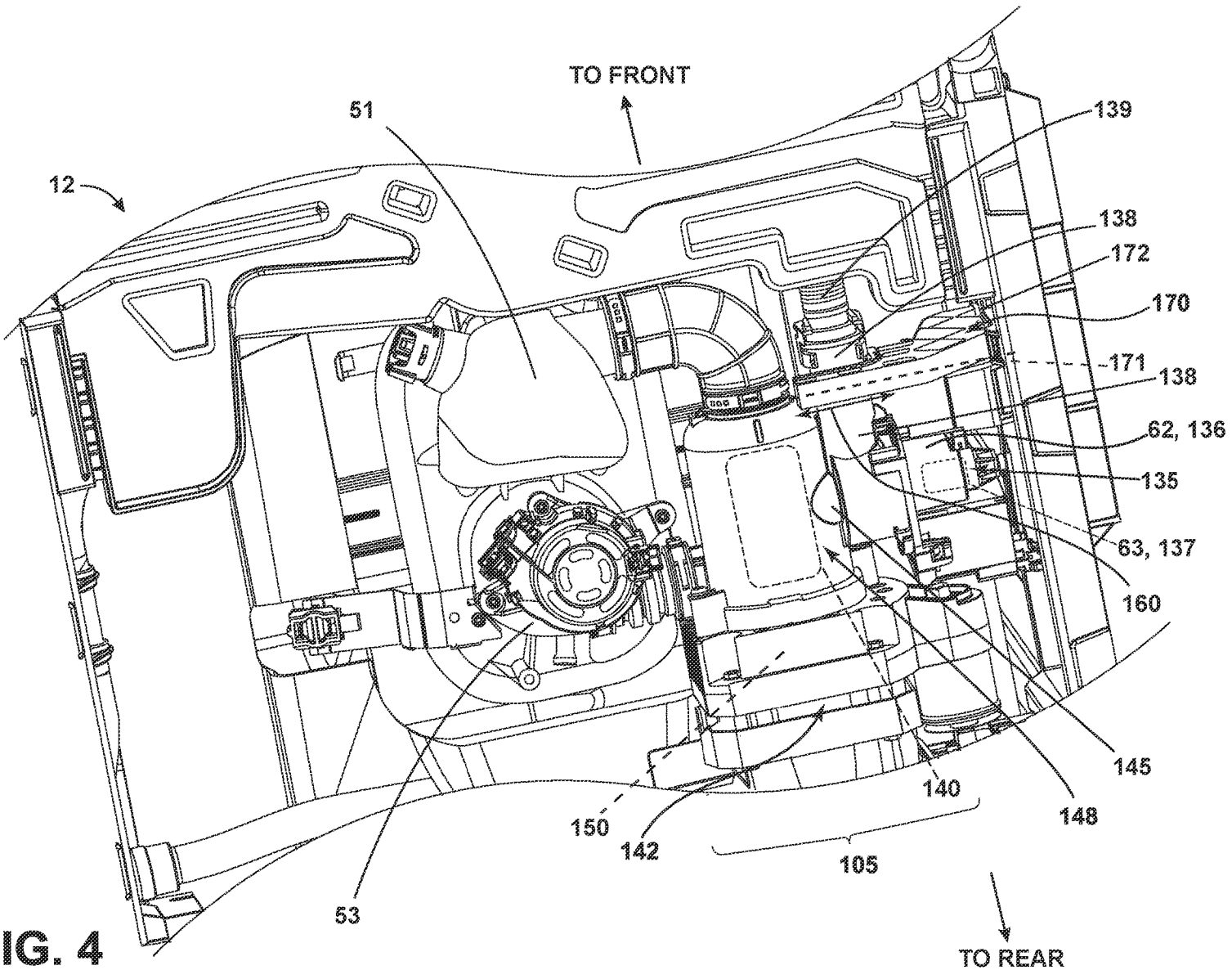
FIG. 4 is a bottom perspective view of the dishwasher of FIG. 1 illustrating a pump and mounting bracket according to various aspects described herein.

Referring now to FIG. 4, a portion of the base 12 of the dishwasher 10 is shown in a bottom view. For reference, directions are indicated toward the front and rear of the dishwasher 10, where the front of the dishwasher includes the door assembly 20 (FIG. 1).

A pump assembly 135 can be secured to the base 12. The pump assembly 135 can include a pump 136 fluidly coupled to at least one of the recirculation system 50 or drain system 60 (FIG. 2). A motor 137 can be included in the pump assembly 135 for driving the pump 136. In the example shown, the pump 136 is illustrated as the drain pump 62, with the motor 137 being illustrated as a drain pump motor 63 driving the drain pump 62. The pump assembly 135 can also include an outlet shaft 138 with a drain pump outlet 139.

The filter system 100 is shown with the rotating inlet filter assembly 105. The filter assembly 105 can include a rotating inlet filter (RIF) 140 and a motor 142. The filter assembly 105 can further include a centrifugal pump 148 having a rotatable impeller 150 rotatably driven by the motor 142, such as via a drive shaft (not shown). For example, the centrifugal pump 148 can define a volute with an inlet fluidly coupled to the treating chamber 16 (FIG. 2) and an outlet fluidly coupled to at least one sprayer, such as any of all of the sprayers 41-45 or 130 (FIG. 2). In such a case, the rotating inlet filter 140 can be located within the volute. In addition, the centrifugal pump 148 can be fluidly coupled to the sump 51, such that the filter assembly 105 forms at least a portion of the sump 51. The outlet shaft 138 can fluidly couple the RIF 140 to the drain pump 62 at a filter outlet 145 as shown.

While illustrated as including the drain pump 62, the pump assembly 135 can also include any or all of the recirculation pump 53, RIF assembly 105, or centrifugal pump 148, as well as any corresponding driving motors.

A mounting bracket 170 can be provided to mount or secure any portion of the pump assembly 135 to the base 12 of the dishwasher 10. In the illustrated example, the mounting bracket 170 is coupled to the outlet shaft 138 proximate the drain pump outlet 139, thereby securing the drain pump outlet 139 to the base 12. A bracket axis 171 can be defined along the mounting bracket 170 as shown. In addition, at least one mount 172 can be provided with the mounting bracket 170 and configured to secure to the base 12. In this manner, the mounting bracket 170 can be configured to secure the pump assembly 135 to the base 12, including via the outlet shaft 138. It will be understood that other mounting brackets can be included to secure the pump assembly 135. In one example, at least one bracket can be provided at the rear side of the drain pump motor 63. In another example, a system of brackets can be provided to secure multiple components to the base 12. Aspects of the mounting bracket 170 can be applied to any mounting bracket utilized anywhere within the dishwasher 10 (FIG. 1).

Operation of the motor 142 can drive the impeller 150 and cause centrifugal separation of particles and fluid within the filter assembly 105. Soils can be removed from wash water flowing through the RIF 140. Operation of the drain pump 62 can direct removed soils or wash water to the drain pump outlet 139 via the drain system 60, and operation of the recirculation pump 53 can direct filtered wash water into the volute to be supplied to the spray system 40 via the recirculation system 50 (FIG. 2).

In addition, operation of the pump assembly 135 can cause vibrational motion of components mounted to the base 12, including any or all of the filter assembly 105, centrifugal pump 53, or drain pump 62. The mounting bracket 170 can provide at least one degree of freedom 160, illustrated with an arrow, for the pump assembly 135. In the example shown, the degree of freedom 160 is along the bracket axis 171. The degree of freedom 160 can also be slightly unaligned with the bracket axis 171. For example, the degree of freedom can differ from the bracket axis by a fixed amount, such as 10 degrees or less, or by a relative amount, such as within 15% of parallel, in non-limiting examples.

Figure 5:
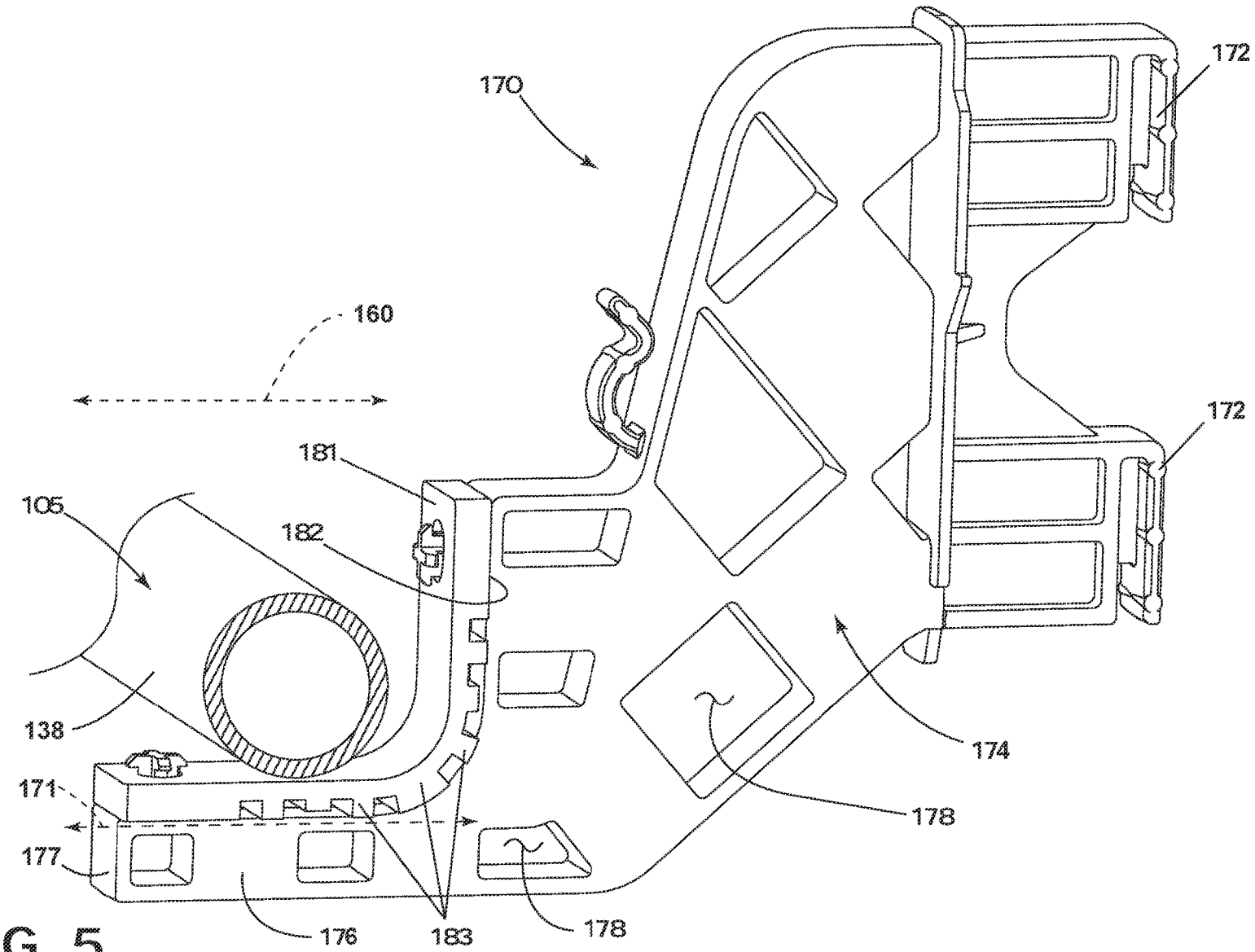
FIG. 5 is a side perspective view of the mounting bracket of FIG. 4.

Turning to FIG. 5, the mounting bracket 170 is shown in further detail. A portion of the outlet shaft 138 is shown resting on the mounting bracket 170, and the degree of freedom 160 of the outlet shaft 138 is also shown.

The mounting bracket 170 can be in the form of an L-shaped body 174 with an arm 176 extending outward, terminating in a distal end 177, and abutting the filter assembly 105, e.g. the outlet shaft 138. The mounts 172, illustrated in the form of clips, are provided along the L-shaped body 174 opposite the arm 176. Optionally, a plurality of apertures 178 can be provided in the body 174 to decrease weight while maintaining needed flexibility or rigidity in the body 174.

A gripping layer 180 can be provided with the mounting bracket 170. The gripping layer 180 can be carried by the arm 176 and positioned or located between the arm 176 and the filter assembly 105. The outlet shaft 138 of the motor 142 in the filter assembly 105 can be carried by the arm 176, resting upon the gripping layer 180. In addition, the gripping layer 180 can include a first surface 181 confronting the outlet shaft 138, and a second surface 182 confronting the arm 176. A plurality of ridges 183 can be provided in the second surface 182 such that the ridges 183 confront the arm 176.

In one example the gripping layer 180 can be formed of a vibration damping material, such as ethylene propylene diene terpolymer (EPDM), natural rubber, silicone, constrained layer damping material, or plastic, in non-limiting examples. In such a case, the vibration damping material can have a high vibration damping performance to attenuate vibrations from the outlet shaft 138. Alternatively, the gripping layer 180 can be formed with multiple materials. In one example, a rigid material (e.g. metal or plastic) can be utilized along the first surface 181 and a vibration damping material (e.g. rubber) can be utilized for the ridges 183 such that the ridges 183 "grip" the arm 176.

It can be appreciated that vibrational motion of the outlet shaft 138 can be in the form of translational motion, rotational motion, or a combination. For example, the outlet shaft 138 can freely roll, or freely slide, back and forth along the arm 176 during operation of the motor 142 (FIG. 4). In this manner, the filter assembly 105 can have at least one degree of freedom that can be translational freedom, rotational freedom, or a combination thereof. Vibrational motion of the filter assembly 105 can be isolated to the filter assembly 105 with less vibration transfer to the mounting bracket 170.

Figure 6:
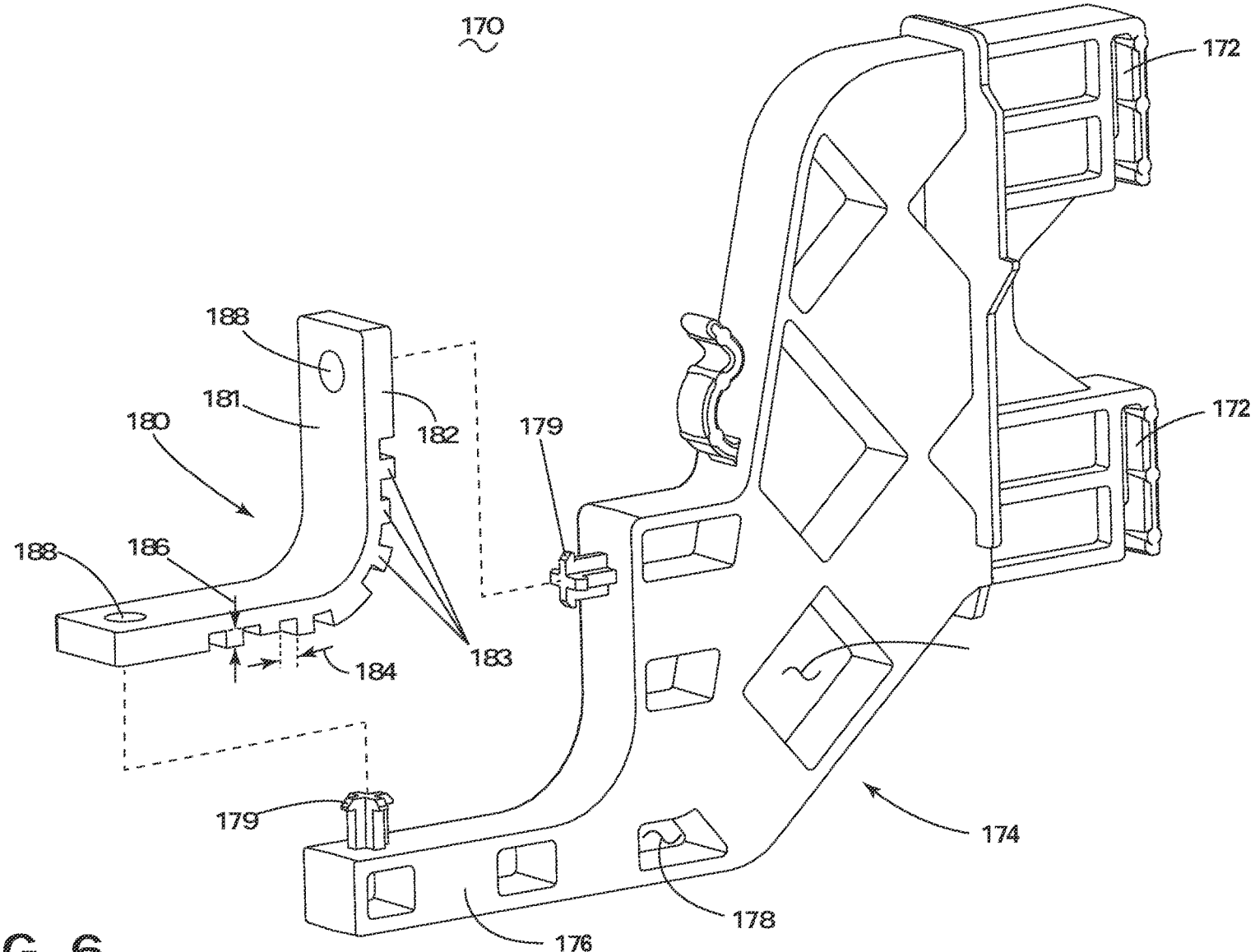
FIG. 6 is a partially-exploded view of the mounting bracket of FIG. 4 illustrating a gripping material.

FIG. 6 illustrates the gripping layer 180 partially exploded from the arm 176. It is further contemplated that each of the ridges 183 can define a spacing distance 184 and a height 186. The height 186 of the ridges 183 can vary, and is illustrated with an alternating pattern of greater and smaller heights 186. In addition, the spacing distance 184 can be greater than or equal to a height 186 of one of the ridges 183.

In addition, the gripping layer 180 can include at least one through hole 188. In the illustrated example, a single through hole 188 is provided at each end of the gripping layer 180. The arm 176 can include at least one projection 179, and is illustrated with two projections 179 corresponding to the two through holes 188. The through holes 188 are configured to receive the corresponding projections 179, such as via an interference fit. By inserting the projections 179 through the through holes 188, the projections 179 can be configured to carry the gripping layer 180 on the arm 176.

Aspects of the disclosure provide for a variety of benefits, including that allowing the motor to have at least one degree of freedom along the arm can reduce vibration transfer from the motor to other components in the dishwasher, including other mounted components in the base, frame, door, and the like. Whereas traditional brackets that constrain motion of mounted elements can cause transfer of vibrational motion or force to adjacent components, the mounting bracket described herein can allow for isolation of vibrational motions along the arm of the bracket. In one example, by allowing the motor shaft to move freely along the arm, vibrations transferred to the bracket were reduced by up to 5 dBa at a vibration frequency of 125 Hz. It can also be appreciated that the choice of material for the gripping layer can also provide for increased isolation or vibration reduction; for example, a rubber gripping layer can provide a greater vibration reduction than a rigid metal gripping layer.

To the extent not already described, the different features and structures of the various aspects can be used in combination with each other as desired. That one feature cannot be illustrated in all of the aspects is not meant to be construed that it cannot be, but is done for brevity of description. Thus, the various features of the different aspects can be mixed and matched as desired to form new aspects, whether or not the new aspects are expressly described. Combinations or permutations of features described herein are covered by this disclosure.

This written description uses examples to disclose aspects of the disclosure, including the best mode, and also to enable any person skilled in the art to practice aspects of the disclosure, including making and using any devices or systems and performing any incorporated methods. While aspects of the disclosure have been specifically described in connection with certain specific details thereof, it is to be understood that this is by way of illustration and not of limitation. Reasonable variation and modification are possible within the scope of the forgoing disclosure and drawings without departing from the spirit of the disclosure, which is defined in the appended claims.

What is claimed is:

1. An automatic dishwasher, comprising:

a tub having a bottom and at least partially defining a treating chamber;

a base supporting the bottom of the tub;

at least one sprayer emitting liquid into the treating chamber;

a recirculation circuit fluidly coupling the tub to the at least one sprayer;

a drain circuit fluidly coupling the tub to a household drain;

a pump assembly having a pump fluidly coupled to at least one of the recirculation circuit or the drain circuit, and a motor driving the pump; and a mounting bracket, comprising:

a body coupled to the base;

an arm projecting at least horizontally from the body to form an L-shaped profile, the arm terminating in a distal end and having a flat upper surface supporting a portion of the pump assembly;

a gripping layer positioned between the arm and the portion of the pump assembly, the gripping layer having a plurality of ridges confronting the arm and forming hollow spaces along the flat upper surface of the arm; and a bracket axis defined along the arm between the body and the distal end;

wherein the arm is configured to allow unconstrained motion of the portion of the pump assembly along the bracket axis.

2. The automatic dishwasher of claim 1 wherein the portion of the pump assembly comprises an outlet shaft, with the arm supporting the outlet shaft.

3. The automatic dishwasher of claim 1 wherein the gripping layer comprises vibration damping material.

4. The automatic dishwasher of claim 3 wherein the vibration damping material comprises at least one of EPDM, natural rubber, silicone, or plastic.

5. The automatic dishwasher of claim 1 wherein the plurality of ridges are spaced from each other by a spacing distance.

6. The automatic dishwasher of claim 5 wherein the spacing distance is greater than or equal to a height of the ridges.

7. The automatic dishwasher of claim 1 wherein the arm comprises at least one projection configured to carry the gripping layer.

8. The automatic dishwasher of claim 7 wherein the gripping layer comprises at least one through hole configured to receive the projection via an interference fit.

9. The automatic dishwasher of claim 1, further comprising at least one degree of rotational freedom for the unconstrained motion such that the portion of the pump assembly rotates relative to the arm.

10. The automatic dishwasher of claim 1, further comprising at least one degree of freedom for the unconstrained motion that is a combination of translational and rotational freedom.

11. The automatic dishwasher of claim 1 wherein the pump further comprises a centrifugal pump having an impeller rotationally driven by the motor.

12. The automatic dishwasher of claim 1 wherein the pump comprises at least one of a recirculation pump, a rotating inlet filter, or a drain pump.

13. The automatic dishwasher of claim 1, further comprising at least one degree of translational freedom for the unconstrained motion such that the portion of the pump assembly translates relative to the arm.

* * * * *